US008096060B1

(12) United States Patent
Storjohann

(10) Patent No.: US 8,096,060 B1
(45) Date of Patent: Jan. 17, 2012

(54) ASSEMBLY FOR LEVELING NEW CONCRETE AND SUB-GRADE

(76) Inventor: Keri J. Storjohann, Johnston, IA (US)

( * ) Notice: Subject to any disclaimer, the term of this patent is extended or adjusted under 35 U.S.C. 154(b) by 0 days.

(21) Appl. No.: 12/893,055

(22) Filed: Sep. 29, 2010

(51) Int. Cl.
*G01C 9/00* (2006.01)
*G01C 15/00* (2006.01)
*E04G 21/00* (2006.01)

(52) U.S. Cl. ..... 33/518; 52/749.13

(58) Field of Classification Search ..... 33/1 LE, 33/518, 526, 365; 52/749.13; 404/72, 118
See application file for complete search history.

(56) References Cited

U.S. PATENT DOCUMENTS 1,963,088 A * 6/1934 Heltzel ..... 404/72
4,228,588 A * 10/1980 Horton, Jr. ..... 33/1 LE
5,033,952 A * 7/1991 Haug ..... 52/749.13
5,173,004 A 12/1992 Fahrenkrog
6,421,926 B1 * 7/2002 Cappuccio ..... 33/413
6,719,486 B2 * 4/2004 Craghan ..... 404/119
7,685,729 B2 * 3/2010 Mershon ..... 33/526
2009/0028638 A1 * 1/2009 Crawford et al. ..... 404/72
2009/0252554 A1 * 10/2009 Lura ..... 404/118
2010/0226718 A1 * 9/2010 Obergfoll ..... 404/118
2011/0091277 A1 * 4/2011 Biodrowski ..... 404/118

* cited by examiner

*Primary Examiner* — G. Bradley Bennett
(74) *Attorney, Agent, or Firm* — Zarley Law Firm, P.L.C.

(57) ABSTRACT

The assembly for leveling new concrete includes a driver that has a guide that is placed in a mounting structure so that the driver may be used to drive the mounting structure into the ground. The driver has both a removable rebar marker and conduit marker so that depending on whether an individual wants to use a screed pipe conduit or rebar as a support structure in their concrete the support structures are properly aligned.

6 Claims, 3 Drawing Sheets

ASSEMBLY FOR LEVELING NEW CONCRETE AND SUB-GRADE

BACKGROUND OF THE INVENTION

This invention relates to tools for establishing guides for placing or pouring concrete and similar work in new concrete construction such as a roadway, driveway, sidewalk, patio, bridges, decks, elevated floors, basements, parking lots and feedlots, or building floor.

In the past it was conventional practice to dig out the ground to a desired depth and then place a string line at the predetermined elevation of the finished concrete surface. Wooden stakes were then driven into the ground and pipes were laid horizontally on top of them. The upper surface of the pipes indicates the desired elevation of the finished concrete. Nails were driven into the stake tops on both sides of the pipe to keep it from rolling or being bumped off. The concrete was then poured or dumped into the desired area and struck or screed off with a strike board or screed on top of adjacent pipes. The pipes may be removed while the concrete is drying or setting and the indentations after removal of the pipes are then filled and the surface smoothed out, thus establishing a finished surface at the desired elevation of the concrete.

The use of wooden stakes with nails at their tops is inefficient, costly and time consuming compared to the material, tools and method of using them in the present invention. Wooden stakes are hard to drive so that their tops are at the required depth below the string line. They must be individually measured from the string line with a tape measure. The wooden stakes split easily when driven into the ground or when driving nails into them for holding the screed pipe. Often the accuracy is lost while driving nails stake tops in sand or soft soil conditions. In cold climates the wooden stakes swell in the concrete, causing cracks in the concrete.

To improve upon this these methods a device was formed that is seen in U.S. Pat. No. 5,173,004 to Fahrenkrog. The '004 patent presents a device with a leveling pin that was used to drive a conduit tube into the ground at a predetermined level. Then a yoke was placed in the tube so that a screed pipe conduit could be placed in the yoke at a desired location as compared to a concrete elevation finish line.

While this improved upon previous methods, problems still remain. Safety issues are presented because a user can hit his hand when driving the conduit through rock. In addition individuals desire to use other materials than conduit in concrete applications. These materials include rebar. Unfortunately, in the '004 design the driver is only effective at properly positioning a conduit. In addition the prior art assembly and method continue to have issues with cost in manufacturing the assembly.

Thus the principal object of the present invention is to provide a more efficient and accurate assembly for leveling concrete and sub-grade.

These and other objects, features, or advantages of the present invention will become apparent from the specification and the claims.

BRIEF SUMMARY OF THE INVENTION

An assembly for leveling new concrete and sub-grade that has a driver with a metal insert. The driver also includes a rebar marker and a conduit marker at separate locations on the driver that both determine a vertical placement of a yoke. The driver is used to drive a mounting structure in the ground and the markers provide how far vertically the mounting structure is to be driven into the ground. Then a yoke is placed in the mounting structure wherein the yoke accommodates a support structure, such as rebar or conduit such that each support structure is vertically aligned.

DETAILED DESCRIPTION OF THE PREFERRED EMBODIMENT

Figure 1:
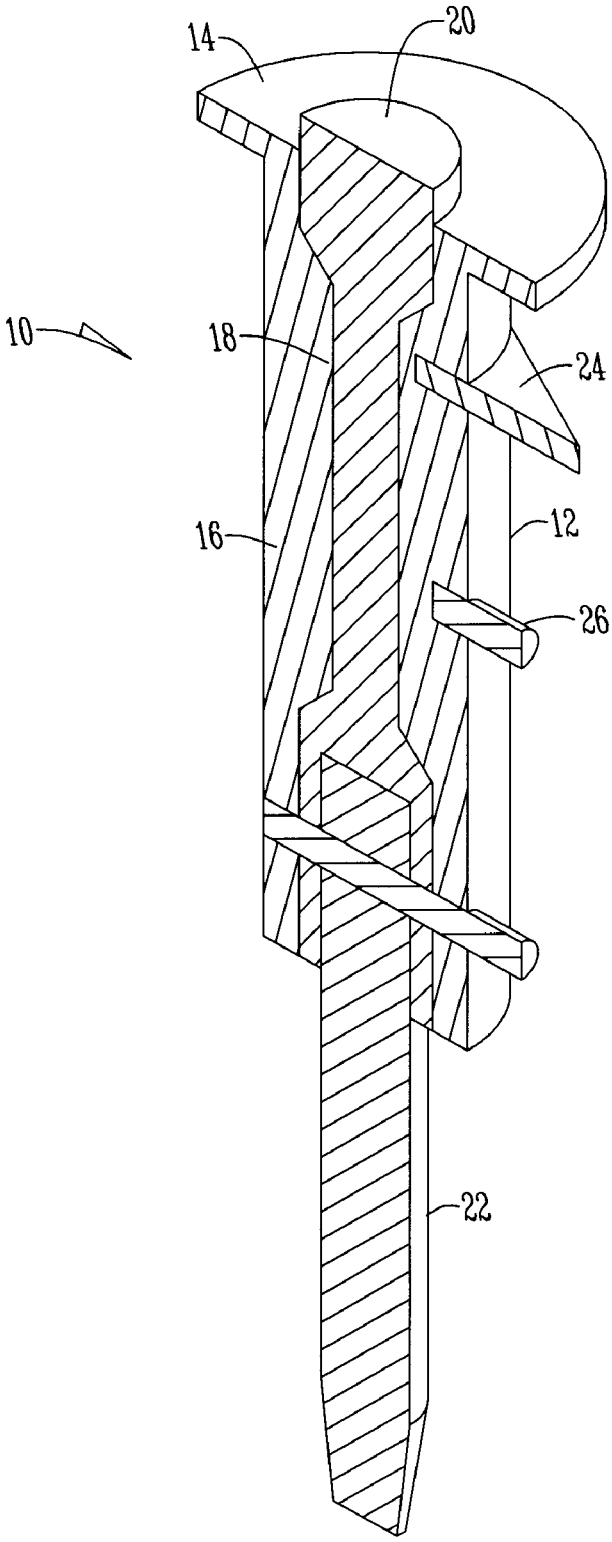
FIG. 1 is a side sectional view of the driver.
Figure 2:
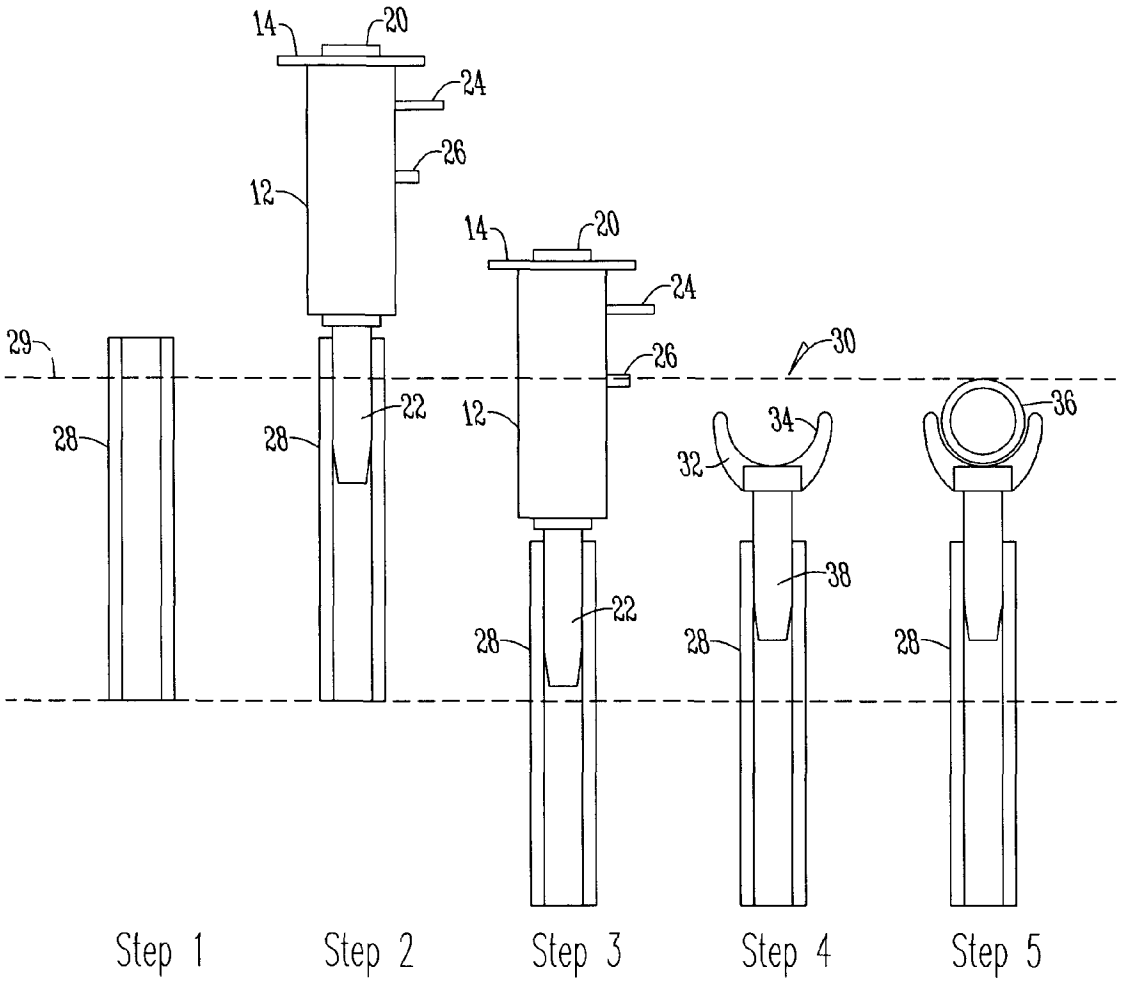
FIG. 2 is a side view of a series of drivers, yokes and mounting structures, illustrating the various steps in the procedure utilized to place screed pipe conduit in place.
Figure 3:
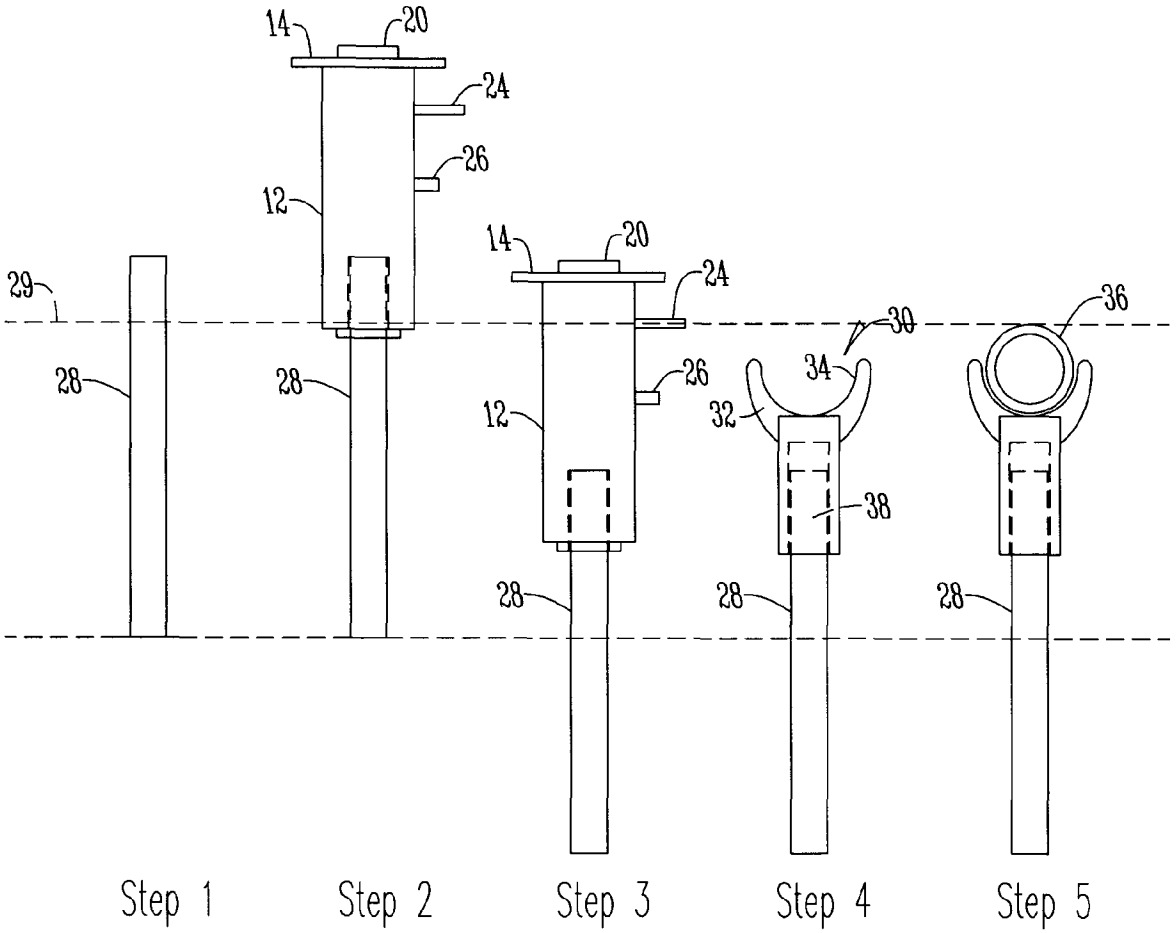
FIG. 3 is a side view of a series of drivers, yokes and mounting structures, illustrating the various steps in the procedure utilized to place rebar in place.

The figures show a driver 10 that consists of an elongated body 12 that has a safety shield 14 with and opening at a first end and has a bore 16 that receives an insert 18 that also has a head 20. In a preferred embodiment the elongated body 12 is made of plastic or nylon while the insert 18 is made of steel or metal. Additionally the head 20 of the insert 18 engages the top of the head 14 of the elongated body 12 to lock the insert 18 within the elongated body 12. Extending through the elongated body 12 and from the insert 18 is a guide or removable post 22.

The driver 10 additionally has a rebar marker 24 and a conduit marker 26. In the embodiment as shown in the figures both the rebar marker 24 and conduit marker 26 are removably disposed through the elongated body 12 and into the insert 18 to secure the markers 24 and 26 therein. The markers 24 and 26 additionally align with the opening 15 of the head 14 of elongated body 12 so that when an individual is hammering the driver 10 they can look through the opening 15 to determine the position of a marker 24 or 26 being used.

The driver 10 is used to drive a mounting structure 28 into the ground at a predetermined height. In one embodiment the mounting structure 28 is a hollow tube that receives the guide 22 whereas alternatively the mounting structure 28 can be rebar where the insert 18 receives the rebar. A string line 29 or laser is then used to present a straight line to establish a height of the finished concrete or sub-grade and the markers 24 or 26 are used to align with the string line 29. The driven head 20 is hammered downward until a marker 24 or 26 aligns and then the next mounting structure 28 can be placed.

Once the mounting structure 28 drives the conduit into the ground at a predetermined height a yoke 30 is placed into the mounting structure 28. The yoke 30 has a cradle 32 and an arcuate loop 34 and is of a size and shape to receive a support body 36 such as screed pipe or rebar. In addition in the embodiment where the mounting structure is a conduit tube the yoke 30 has a tube or stem 38 extending therefrom that extends into the mounting structure 28 to hold the yoke 30 in place. In the embodiment where the mounting structure is rebar, the yoke fits over the rebar accordingly. In a preferred embodiment the yoke and stem 38 have a plurality of indentations 40 in order to reduce the amount of materials needed to manufacture the yoke 30. In yet another embodiment the stem 38 is threaded so that a nut can be used for precise height placement and accuracy. Again, this eliminates materials and provides a more secure connection in the mounting structure 28.

In operation an individual determines whether they will use conduit, rebar or other support structure when making their concrete. Thus if they use the rebar an individual inserts the rebar marker 24 into the driver 10. At this time the individual places the guide 22 into the mounting structure 28 and hammers the head 20 of the insert 18 of the driver 10 until the marker 24 lines with a string line 29. The driver 10 is then removed and the yoke 30 is placed within the mounting structure 28 such that rebar may be placed in the yoke 30. In this manner the rebar marker 24 determines the vertical placement of the yoke 30 for the rebar or support body 36.

When a user decides to use conduit as the support structure 36 the rebar marker 24 can be removed and a conduit marker 26 placed within the driver 10. Then again at this time the driver 10 can then be used to hammer the mounting structure 28 into the ground until the conduit marker 26 aligns with the horizontal string line 29. The driver may then be removed so that the yoke 30 that supports the screed pipe conduit can be placed in the mounting structure 28 to receive the conduit. In this manner the driver 10 utilizes the conduit marker 26 to determine a vertical placement of the yoke 30 for such conduit.

Thus presented is an assembly for leveling new concrete or sub-grade that allows for both the proper placement of rebar and conduit. Specifically, by having the interchangeable rebar and conduit markers 24 and 26 either type of support structure 36 may be properly aligned. In addition because of the opening 15 in the head 14 of the elongated body 12, faster, a safety shield may be utilized for additional protection. In addition because of the indentations 40 and structure of the yoke 30 and stem 38 less material is used eliminating manufacturing costs. Further, by having an insert 18 that is made of steel within a plastic or nylon housing or elongated body 12, again a more accurate and safe design is presented that minimizes concrete cracking and other problems associated with the prior art. Thus at the very least all of the stated objectives have been met.

It will be appreciated by those skilled in the art that 10 other various modifications could be made to the device without the parting from the spirit and scope of this invention. All such modifications and changes fall within the scope of the claims and are intended to be covered thereby.

What is claimed is:

1. An assembly for leveling new concrete comprising:

a driver having a rebar marker that determines a vertical placement of a yoke for rebar; and said driver having a conduit marker for determining a vertical placement of the yoke for conduit.

2. The assembly of claim 1 wherein the driver has an insert disposed therein that receives a guide.

3. The assembly of claim 2 wherein the insert is steel.

4. The assembly of claim 3 wherein the elongated body is plastic.

5. The assembly of claim 1 wherein the yoke has a stem that is ribbed.

6. The assembly of claim 1 wherein the yoke has a plurality of indentations.

* * * * *